US010273113B2

(12) United States Patent
Kotzur et al.

(10) Patent No.: US 10,273,113 B2
(45) **Date of Patent: *Apr. 30, 2019**

(54) APPARATUS AND METHODS FOR WINDING COIL

(71) Applicant: REELEX Packaging Solutions, Inc., Patterson, NY (US)

(72) Inventors: Frank W. Kotzur, Carmel, NY (US); Scott Kotzur, Carmel, NY (US); Michael Muller, Modena, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 155 days.

This patent is subject to a terminal disclaimer.

(21) Appl. No.: 15/664,549

(22) Filed: Jul. 31, 2017

(65) Prior Publication Data

US 2017/0327340 A1 Nov. 16, 2017

Related U.S. Application Data

(63) Continuation of application No. 14/740,571, filed on Jun. 16, 2015, now Pat. No. 9,731,931.

(60) Provisional application No. 62/054,225, filed on Sep. 23, 2014.

(51) Int. Cl.

| | |
|---|---|
| ***B65H 54/10*** | (2006.01) |
| ***B65H 55/04*** | (2006.01) |
| ***B65H 59/36*** | (2006.01) |
| ***B65H 59/38*** | (2006.01) |

(52) U.S. Cl.
CPC ..... *B65H 55/046* (2013.01); *B65H 54/10* (2013.01); *B65H 59/36* (2013.01); *B65H 59/385* (2013.01); *B65H 59/387* (2013.01)

(58) Field of Classification Search
CPC ..... B65H 54/10; B65H 54/24; B65H 54/36; B65H 55/046; B65H 59/385; B65H 59/387
See application file for complete search history.

(56) References Cited

U.S. PATENT DOCUMENTS

| | | | |
|---|---|---|---|
| 2,634,922 | A | 4/1953 | Taylor, Jr. |
| 4,238,084 | A | 12/1980 | Kataoka |
| 5,470,026 | A | 11/1995 | Kotzur |
| 8,079,539 | B2 | 12/2011 | Huang et al. |
| 9,731,931 | B2 | 8/2017 | Kotzur et al. |

*Primary Examiner* — William E Dondero
(74) *Attorney, Agent, or Firm* — Gordon & Jacobson, P.C.

(57) ABSTRACT

Systems and methods for winding wire are disclosed. A system includes a wire take-up unit and a wire tensioning unit. The take-up unit includes a rotating mandrel and a wire directing device, the wire directing device arranged to cause the wire to be wound in a figure-eight configuration on the rotating mandrel to form a coil having many layers of wire. The wire tensioning unit applies tension to said wire as it is wound, and applies a first amount of tension to a predetermined amount of wire constituting at least a first two layers of the coil, and a second amount of tension to the wire beyond the predetermined amount. In one embodiment, the wire tensioning unit includes digital self-relieving air regulator pneumatically coupled to and controlling a pressure in said pressurized chamber of a pre-lubricating cylinder that is coupled to the wire being wound.

20 Claims, 4 Drawing Sheets

APPARATUS AND METHODS FOR WINDING COIL

This application is a continuation of copending U.S. patent application Ser. No. 14/740,571, filed on Jun. 16, 2015, which claims the benefit of priority under 35 U.S.C. § 119(e) to U.S. provisional application Ser. No. 62/054,225, filed Sep. 23, 2014, which are hereby incorporated by reference herein in their entirety.

BACKGROUND

1. Field

This application relates to apparatus and methods for winding coils. More particularly, this application relates to apparatus and methods for winding coils of cable, wire, or filaments that are adapted to dispense through a payout tube. This application has particular application to the winding of twisted-pair data cable in a figure-eight pattern, although it is not limited thereto.

2. State of the Art

U.S. Pat. No. 2,634,922 to Taylor describes the winding of flexible wire, cable or filamentary material (hereinafter "wire", which is to be broadly understood in the specification and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX (a trademark of Reelex Packaging Solutions, Inc.) -type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire.

Over the past fifty-plus years, improvements have been made to the original invention described in U.S. Pat. No. 2,634,922. For example, U.S. Pat. No. 5,470,026 to Kotzur describes means for controlling the reciprocating movement of the traverse with respect to the rotation of the mandrel in order to wind the wire on the mandrel to form a radial payout hole having a substantially constant diameter. In addition, over the past fifty-plus years, an increasing number of different types of wires with different characteristics are being wound using the systems and methods described in U.S. Pat. No. 2,634,922 and the subsequent improvements. For example, the figure-eight type winding has been used for twisted-pair type cable (e.g., Category 5, Category 6 and the like), drop cable, fiber-optic cable, electrical building wire (THEN), etc. Despite the widespread applicability of the technology, challenges remain in applying the technology to different wires.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One embodiment of a system for winding a wire includes a spindle shaft with a mandrel thereon, a traverse for directing the wire onto the rotating mandrel in a figure-eight pattern, and a tensioner (also called a "dancer" or "accumulator") that controls the tension on the wire as the wire is applied to the rotating mandrel. In one embodiment, the tensioner is controlled by a regulator that causes the tension on at least the first two layers of wire laid down on the mandrel to be at a relatively lower tension relative to the tension applied on the remainder of the wire as it is wound onto the mandrel. In another embodiment, the tension on a predetermined length of wire that is laid down as the first two to four layers of wire is tensioned at a tension that is lower relative to the tension applied to the remainder of the wire.

In one embodiment, the increase in tension after the initial low-tension winding portion is a substantially immediate increase to the desired winding tension for the remainder of the wire winding. In another embodiment, the increase in tension after the initial low-tension winding portion is gradual or stepped until the desired winding tension for the remainder of the wire winding is obtained.

In one embodiment, the tensioner used for a system for winding a wire includes an upper sheave, a bottom sheave, and a pneumatic cylinder that applies pressure to the bottom sheave to effect a desired tension. The pneumatic cylinder is controlled by a digital self-relieving air regulator that includes a digital regulator in line with a self-relieving pressure relay. A self-lubricated cylinder is utilized thereby eliminating lubricator-caused back-pressure in the system when the cylinder is exhausted.

According to one aspect, with a winding system where the first two to four layers or a predetermined length of wire are/is wound at a low tension relative to a higher tension for the remainder of the coil, physical deformity of the wire at crossovers is avoided and cable signal performance is increased relative to wires wound into a coil at the constant higher tension. At the same time, the overall size of the coil for a given length of wire remains substantially the same, as it is only the first few layers of wire that are wound at a lower tension.

DETAILED DESCRIPTION

Figure 1:
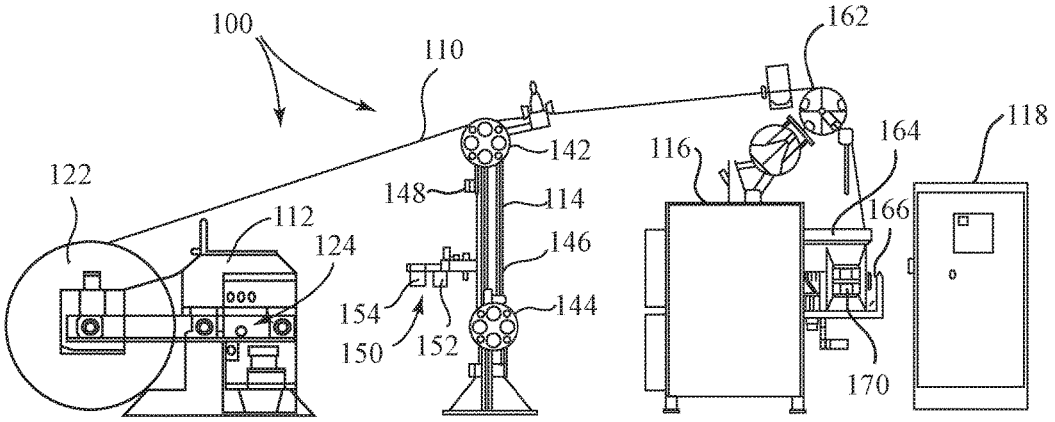
FIG. 1 is a schematic of an embodiment of a REELEX-type winding system.
Figure 5:
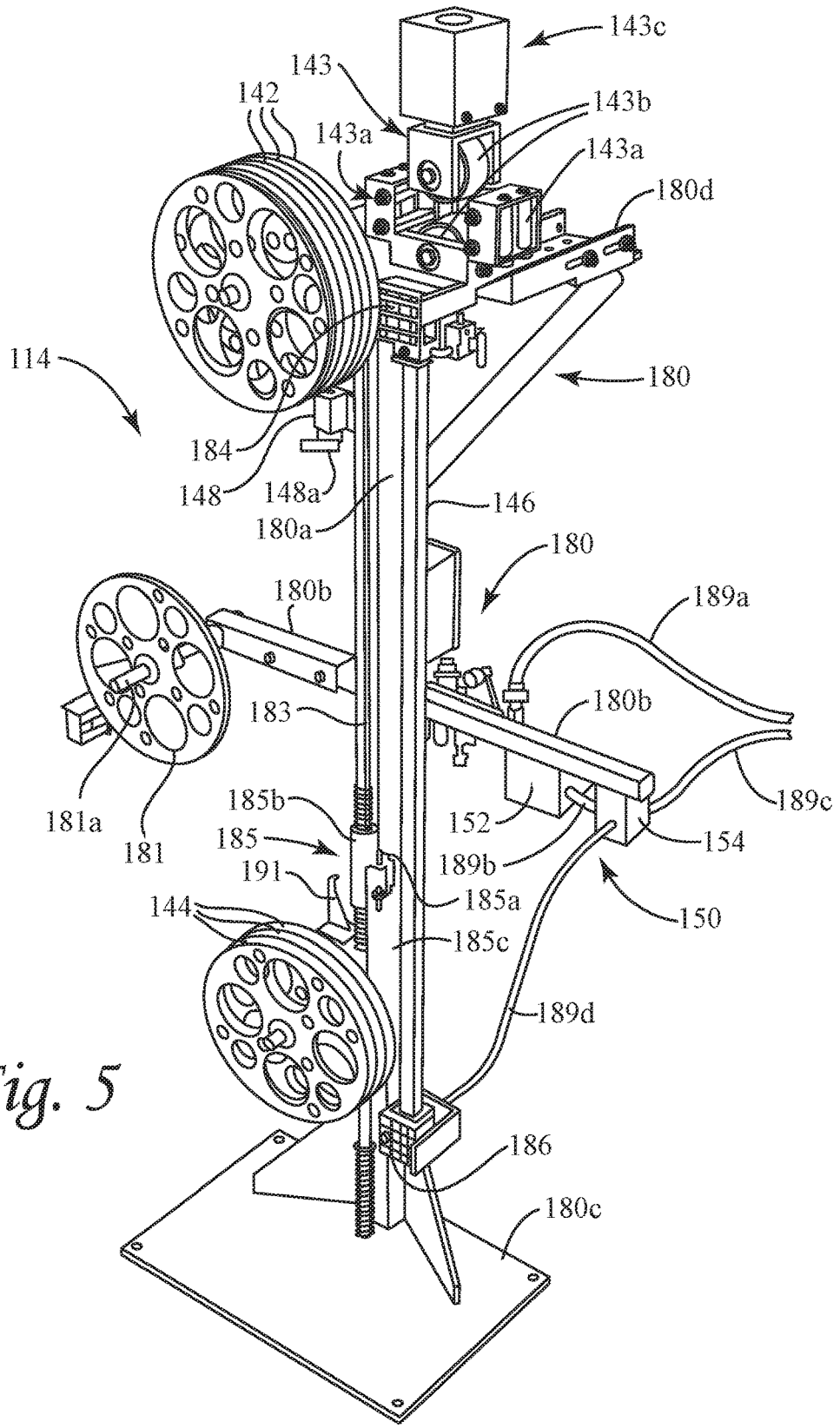
FIG. 5 is a schematic of one embodiment of a winding system dancer.

One embodiment of a winding system 100 for winding wire 110 is seen in FIG. 1. System 100 is a REELEX-type winding system and is shown with a payoff or payout unit 112, a dancer/accumulator (tensioner) 114, a take-up unit 116, and a controller 118. Each of these elements will be described in more detail hereinafter. To start, it should be appreciated that the payoff unit 112 is shown as including a large source reel 122 of wire 110 and a motor 124 that is used to control the speed at which the wire 110 is dispensed off of the reel 122. The dancer/accumulator or tensioner 114, which is described in more detail with respect to FIG. 5, is shown with upper sheaves 142 and lower sheaves 144 around which the wire 110 wraps, a pneumatic cylinder 146 that applies pressure to the lower sheaves 144 of the tensioner 114 to effect a desired tension, and a distance or height sensor 148 (e.g., a laser system) that senses the location of the lower sheave 144 relative to the upper sheave 142. The height sensor 148 is coupled to the payoff unit 112 and can provide feedback information to the payoff unit 112, thereby informing the payoff unit to increase its speed if the amount of wire in the accumulator is low, and informing the payoff unit to decrease its speed if the amount of wire in the accumulator is high. In another embodiment, the feedback information may be provided to the take-up unit 116 and used to decrease or increase the speed thereof. As will be described in more detail hereinafter, the pneumatic cylinder 146 that applies tension to the wire 110 is controlled by a digital self-relieving air regulator 150 that includes a digital regulator 152 in line with a self-relieving pressure relay 154. The cylinder 146 is self-lubricating, thereby eliminating the need for an external lubricator which could otherwise cause back-pressure in the system when the cylinder is exhausted of air. The take-up unit 116 is shown to include a buffer 162, a traverse 164, a motorized spindle 166, and a mandrel 170 which is described in more detail with respect to FIG. 2. The traverse moves back and forth above the surface of the mandrel 170 as the mandrel is spinning on the spindle 166, thereby causing wire 110 to be directed onto the mandrel 170. The function of the entire system 100 is to cause wire 110 to be wound in a figure-eight pattern in a manner forming a payout hole extending radially out from the mandrel 170. The controller 118 is coupled to the take-up system 116 and can provide speed control information to direct the take-up system 116 to run at a desired rate. For example, the controller 118 may direct the take-up system 116 to cause the spindle 166 to run at a constant speed, or may cause the take-up system 116 to have the line speed be constant, thereby requiring the spindle speed to slow down over a period of time.

Figure 2:
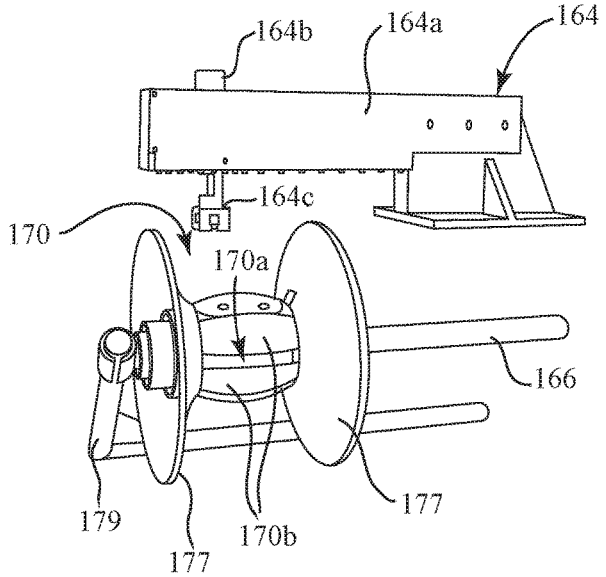
FIG. 2 is a perspective view of the traverse and mandrel of FIG. 1.

Turning now to FIG. 2, a perspective view of the traverse 164 and mandrel 170 of the take-up unit 116 of system 100 are seen in more detail. Mandrel 170 is comprised of a central hollow cylindrical element 170*a* that extends around and is coupled to the spindle 166, and a plurality of segments 170*b* radially attached to the central element 170*a*. Each segment 170*b* of the mandrel is shown with an outer surface that is bowed out (convex) in two directions. Each segment 170*b* also has an inner surface that is concave in at least one direction. Each segment is coupled to the central element 170*a* via at least one arm or rod (not shown) which are arranged to rotate so that the segments 170*b* can move from a first collapsed position (not shown) where the segments are closer to the central element 170*a* and to each other, to a second expanded or extended position shown in FIG. 2 where the segments 170*b* are further away from the central element 170*a* and are spaced further from each other. In the first collapsed position, the segments may touch each other or be very closely adjacent to each other. In the first collapsed position, the segments take the shape of a bumpy barrel. In the second expanded or extended position seen in FIG. 2, the segments are spaced from one another and their outer surfaces appear at any cross-section to define a circle, although again, the circle may be slightly bumpy. A lock may be provided to keep the segments in the expanded position and/or in the collapsed position.

As seen in FIG. 2, the end-forms 177 may be provided that sandwich the mandrel segments 170*b* and extend radially from the central element 170*a*. In the embodiment of FIG. 2, the end-forms 177 are shaped substantially as cymbals and are disposed on the mandrel such that they are faced away from each other. At least one of the end-forms 177 (e.g., the outer end-form) may be removed from the mandrel so that a coil of wire may be removed from the mandrel after a winding is completed. In one embodiment, an end-form arm 179 is provided and may be activated to cause automated removal of the outer end-form 177 when the mandrel is not spinning.

The traverse 164 is formed as a cantilevered beam 164*a* having a longitudinal slot (not shown) through which a guide tube 164*a* extends. Guide tube 164*b* terminates in a wire guide 164*c* which is located closest to the mandrel 170. The wire 110 is threaded through the guide tube 164*b* and exits the wire guide 164*c*. The guide tube 164*b* travels in (i.e., reciprocates in) the longitudinal slot of the beam 164*a* at desired speeds and along desired distances as controlled by the take-up system 116 as optionally informed by the controller 118 in order to form the figure-eight pattern in a manner forming a payout hole.

Figure 3:
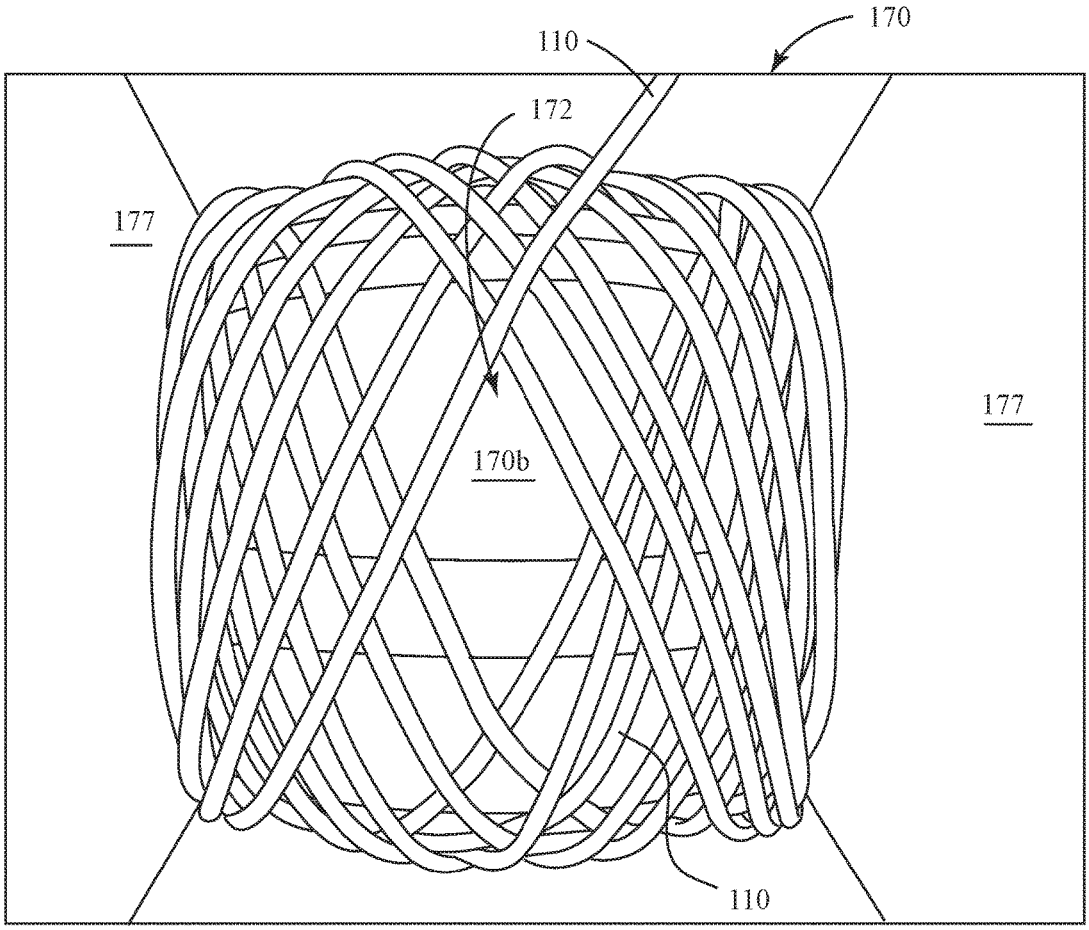
FIG. 3 is a schematic of the mandrel of FIG. 1 with a first layer of wire on the mandrel.

In winding a figure-eight coil of wire, an end of the wire 110 is captured by the mandrel 170, and the mandrel is spun by the spindle 166 as the traverse 164 reciprocates and guides the wire onto the mandrel in a figure-eight pattern with a payout hole. The start of that process is seen in FIG. 3, where a first layer of the wire 110 is seen laid down on the mandrel 170 with portions of the surface of the mandrel segments 170*b* still being seen. In FIG. 3, the first layer is complete in that the movement of the traverse has completed a "super-cycle" (as discussed hereinafter) such that further laying down of wire will be located directly above (i.e., radially further away from the mandrel) where previous wire was laid down. This may also be appreciated by recognizing that a payout hole 172 is fully defined. According to one aspect, and as described in more detail hereinafter, the dancer or tensioner 114 causes the tension on at least the first two layers of wire 110 laid down on the mandrel 170 by the traverse 164 to be at a relatively lower tension relative to the tension applied on the remainder of the wire as it is wound onto the mandrel 170. In another embodiment, the tension on a predetermined length of wire that is laid down as the first two to four layers of wire is tensioned at a tension that is lower relative to the tension applied to the remainder of the wire. The finished coil will have many layers. For purposes herein, the term "many layers" shall mean at least ten layers.

By way of example only, in a winding machine, if the traverse makes one complete cycle for each two revolutions of the mandrel, a figure-eight will be wound on the surface of the mandrel. With each two revolutions of the mandrel, the figure-eights will be wound, essentially in the same location. This location may be called "location zero". If a speed bias (plus or minus) is set into the traverse, the figure-eights will lie at different locations other than location zero. For instance, if the traverse is set with a 5% (plus) speed bias, the traverse will have completed its cycle before the mandrel has reached its starting point. When the mandrel has made its two revolutions (720 degrees), the traverse, by virtue of its +5% bias will be into its new cycle by thirty-six degrees (0.05×720). As a result, the next figure-eight will be thirty-six degrees ahead (i.e., in the same direction as the rotation of the mandrel) of the previous figure-eight. If the speed bias of the traverse is set to a −5%, the second figure-eight will lie behind (i.e., in the direction opposite the rotation of the mandrel direction) the first one. If the traverse speed bias is set to +5% and allowed to continue, eventually, after twenty spindle revolutions, the tenth figure 8 will have advanced 360 degrees and will lie on top of the first wound figure-eight. If, instead of allowing this to continue, the traverse speed bias is changed to −5% after sixteen mandrel revolutions, the ninth and tenth figure-eight for that layer will not be present. There will be a void on the surface of the mandrel for this first layer that is seventy-two degrees of the mandrel surface (as in FIG. 3). Continuing with the −5% traverse speed bias, with each two mandrel revolutions, the figure-eights will lie behind the previous one wound by thirty-six degrees. Eventually, the figure-eights will have returned to the zero position, thereby completing a super-cycle. By repeating this process between plus and minus, a coil will be produced that has a radial hole that is seventy-two degrees of its circumference.

With the stated example, it is clear that much of the first layer of wire is on the surface of the mandrel. With an advance (plus or minus) of 5%, there are spaces of thirty-six degrees between the strands and the cross-overs of the figure-eights. This means that at the surface of a typical eight inch diameter mandrel, the cross-overs and strands of the product will be approximately 2.5 inches apart. If the wire being wound has a diameter of 0.23 inches, it can be appreciated that more than one layer can have portions lie on the surface of the mandrel simply by slipping into those spaces (seen in FIG. 3). Thus, in one embodiment, one or more layers above the first can have at least some wire in contact with the mandrel surface. It should also be evident that the layers above the first layer have portions lying on the surface of the mandrel that are further from the area near the cross-over region. This means that for those layers, the material being wound will experience larger bends at the cross-over region. Indeed, the first two, three, or four layers will experience larger bending than the remainder of the coil. As additional wire is wound, the layers will not have as much bending because the wound material tends to be somewhat flexible, thereby cushioning the upper layers, whereas the mandrel is not yielding.

For a typical Category 5e cable (wire), there are usually ten or eleven figure-eights per layer. This means that each layer consists of approximately (for purposes herein, the term "approximately" should be understood to be plus or minus 10%) forty-five feet of wire per layer. Thus, according to one aspect, a predetermined length of wire that should cover at least two layers could be wound with a lower tension. By way of example only, for the given example, at least ninety feet of coil could be wound with a lower tension. Or, at least one hundred feet of coil (two plus layers) could be wound with a lower tension. Or, at least one hundred thirty-five feet of coil (i.e., approximately three layers) could be wound with a lower tension. Or, one hundred-fifty feet of coil (three plus layers) could be wound with a lower tension. Or, one hundred eighty feet of coil (approximately four layers) could be wound with a lower tension. Or, between ninety and one hundred eighty feet of coil could be wound with a lower tension.

In one aspect, the "lower" tension during the winding of the first few layers is set to be as low as reasonably possible while permitting winding to take place. By way of example, the lower tension may be set at between two and six pounds per square inch. As another example, the lower tension may be set at between three and five pounds per square inch. By way of example, the higher tension for winding a coil may be set at between eight and twenty-five pounds per square inch. As another example, the higher tension may be set at between ten to twenty pounds per square inch. According to one embodiment, the "higher" tension is at least 50% higher than the lower tension. In one embodiment, at least fifty percent of the layers of the coil are wound at the higher tension. In another embodiment, at least seventy-five percent of the layers of the coil are wound at the higher tension. In another embodiment, at least ninety percent of the layers of the coil are wound at the higher tension. In this manner, the integrity of the wire for transmitting signals is maintained while the overall coil size is kept smaller.

Figure 4A:
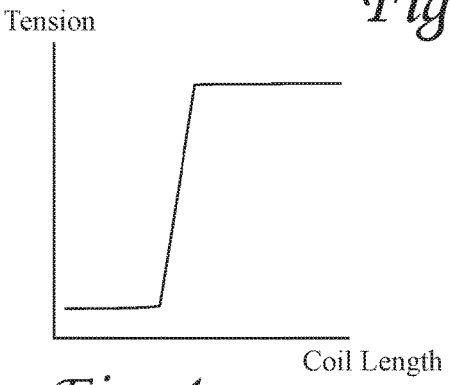
FIG. 4*a* is a plot of coil tension versus coil length according to one embodiment.

According to one embodiment, and as seen in FIG. 4*a* where the coil tension is plotted as a function of wire length, the first few layers or a predetermined length of the wire of the coil may be wound at a first tension, and then the tension is increased as quickly as possible so that the remainder of the coil is wound at a substantially constant higher tension. The transition from winding at a first tension to winding at a second tension is accomplished by having the controller cause the accumulator/tensioner to increase the tension at the appropriate time. The determination of the appropriate time may be accomplished by any of several methods and means such as, by way of example, and not by way of limitation, using one or more appropriate monitors (sensors) to monitor (sense) one or more of: the amount of wire leaving the accumulator, the amount of wire being wound onto the mandrel, the number of rotations of the mandrel, the number of reciprocations of the traverse, and the thickness of the wire on the mandrel. As another alternative, a clock (time monitor) may be used to determine the appropriate time for tension transition based on a knowledge of the rate at which the wire is to be wound. The information obtained by the monitor is an indication that the tension on the wire should be increased. In the embodiment of FIG. 4*a*, the transition from the low first tension to the high second tension is accomplished within a few reciprocations of the traverse, and in any event in less time than it takes to generate one layer of coil.

Figure 4B:
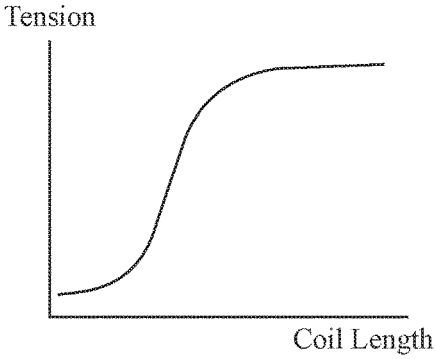
FIG. 4*b* is a plot of coil tension versus coil length according to another embodiment.

FIG. 4*b* is a plot of coil tension versus coil length according to another embodiment. In the embodiment of FIG. 4*b*, upon reaching the desired wire length or number of layers wound on the mandrel, the tension is increased over a period of time until the desired higher winding tension is obtained. Again, control of the winding tension is accomplished by having the controller cause the accumulator/tensioner to apply a relatively low tension during the start of the coil and to gradually increase the tension at the appropriate time until the high winding tension is obtained. In the embodiment of FIG. 4*b*, the transition from the low first tension to the high second tension is accomplished over a period of time equal to or greater than it takes to generate one layer of coil.

In another embodiment, after starting the winding with a low tension and increasing the tension after the desired wire length or number of layers have been wound, the tension on the wire may be decreased gradually over time.

A more detailed schematic of the dancer 114 of FIG. 1 is seen in FIG. 5. As previously indicated, dancer 114 is provided with a plurality of upper sheaves 142 and a plurality of lower sheaves 144 around which the wire 110 can wrap, a self-lubricated pneumatic cylinder 146 that applies pressure to the lower sheaves 144 of the tensioner 114 to effect a desired tension, a distance or height sensor 148 (e.g., a laser system) that senses the location of the lower sheave 144 relative to the upper sheave 142, and a digital self-relieving air regulator 150 that controls the pneumatic cylinder 146, where the digital self-relieving air regulator 150 includes a digital regulator 152 in line with a self-relieving high relief pressure relay 154. More particularly, dancer 114 includes structural beams and platforms 180, including a vertical beam 180*a*, a horizontal beam 180*b*, floor plate 180*c*, and an upper platform 180*d*. The vertical beam 180*a* is coupled to the floor plate 180*c*. The horizontal beam 180*b* and upper platform 180*d* are supported by the vertical beam 180*a*. The vertical beam 180*a*, horizontal beam 180*b*, and upper platform 180*d* support multiple elements of the dancer 114.

The wire 110 that is to be wound on the mandrel 170 can be fed to the upper sheaves 142 (as shown in FIG. 1), or may be fed to an optional input sheave 181 (which may alternatively be used as an output sheave) that is supported by horizontal beam 180*b* via an axle 181*a* supported by the horizontal beam. From the upper sheaves 142 or the input sheave 181, the wire is wound around a sheave of the lower sheaves 144, and then up to the upper sheave(s) 142 and then through a footage (wire length) counter 143 and out to the take-up unit 116. The footage counter 143, which is supported by upper platform 180*d*, includes two sets of two horizontally spaced guide rollers for guiding the wire 110, at least one set of vertically spaced rollers 143*b* (with spacing optionally controlled by a cylinder in box 143*c*), and an encoder 143*c* that monitors rotation of the vertically spaced rollers 143*b*. As wire is pulled through the vertically spaced rollers 143*b*, the rollers rotate thereby indicating length of wire passing therethrough. The encoder 143*c* is electrically coupled to the controller 118 and, based on the rotation of the rollers 143*b*, the controller 118 can determine the length of wire 110 that has been pulled through the footage counter.

As the wire 110 is fed through the dancer, the dancer 114 applies controlled force on the wire to place the wire under tension. In particular, a tensioning system includes a (pre-lubricated) pneumatic cylinder 146 having an internal piston (not shown) lubricated with a lubricious substance such as Magnalube-G, a polytetrafluoroethylene (PTFE) impregnated grease available from Magnalube, Inc. of Linden, N.J. The piston is coupled to a cable 183 that runs from the top of the piston, out through a gasket (not shown) at the top of the cylinder 146, around a wheel 184 at the top of the cylinder, down through a bearing block 185 to which the cable is connected, around another wheel 186 at the bottom of the cylinder 146, and back into the cylinder and to the bottom of the piston via a gasket (not shown) at the bottom of the cylinder. As will be discussed hereinafter, the piston effectively divides the cylinder into a bottom chamber and an upper chamber, with the bottom chamber being pressurized.

In the dancer 118 of FIG. 5, the bottom sheaves 144 are capable of moving up and down ("dancing") relative to the upper sheaves 142 in order to accommodate changes in length that result from differences in the speed of the payoff 112 and takeup 116 units while maintaining a constant tension. More particularly, bearing block 185, to which the cable 183 is connected, includes a cable connecting portion 185*a* and a tube portion 185*b* which may be coupled to the lower sheaves 144 via a plate 185*c*. The tube portion 185*b* of the bearing block extends around and rides along a vertical bar 187 which extends between base 180*c* and platform 180*d*. With the provided arrangement, movement of the lower sheaves 144 up or down along bar 187 involves movement of the bearing block 185 against the force of cable 183 and its connected piston, which in turn is controlled by the pressure of the lower chamber of the cylinder 146. Stated differently, the force at which the piston in the cylinder 146 pulls the dancer wire 183 downward is applied to the bearing block 185 and ultimately to the lower sheaves 144, and thereby accordingly tensions wire 110 which is extending around the lower sheaves 144 and the upper sheaves. Thus, by controlling the force on the piston in the cylinder 146, the tension on the wire 110 can be controlled.

Figure 6:
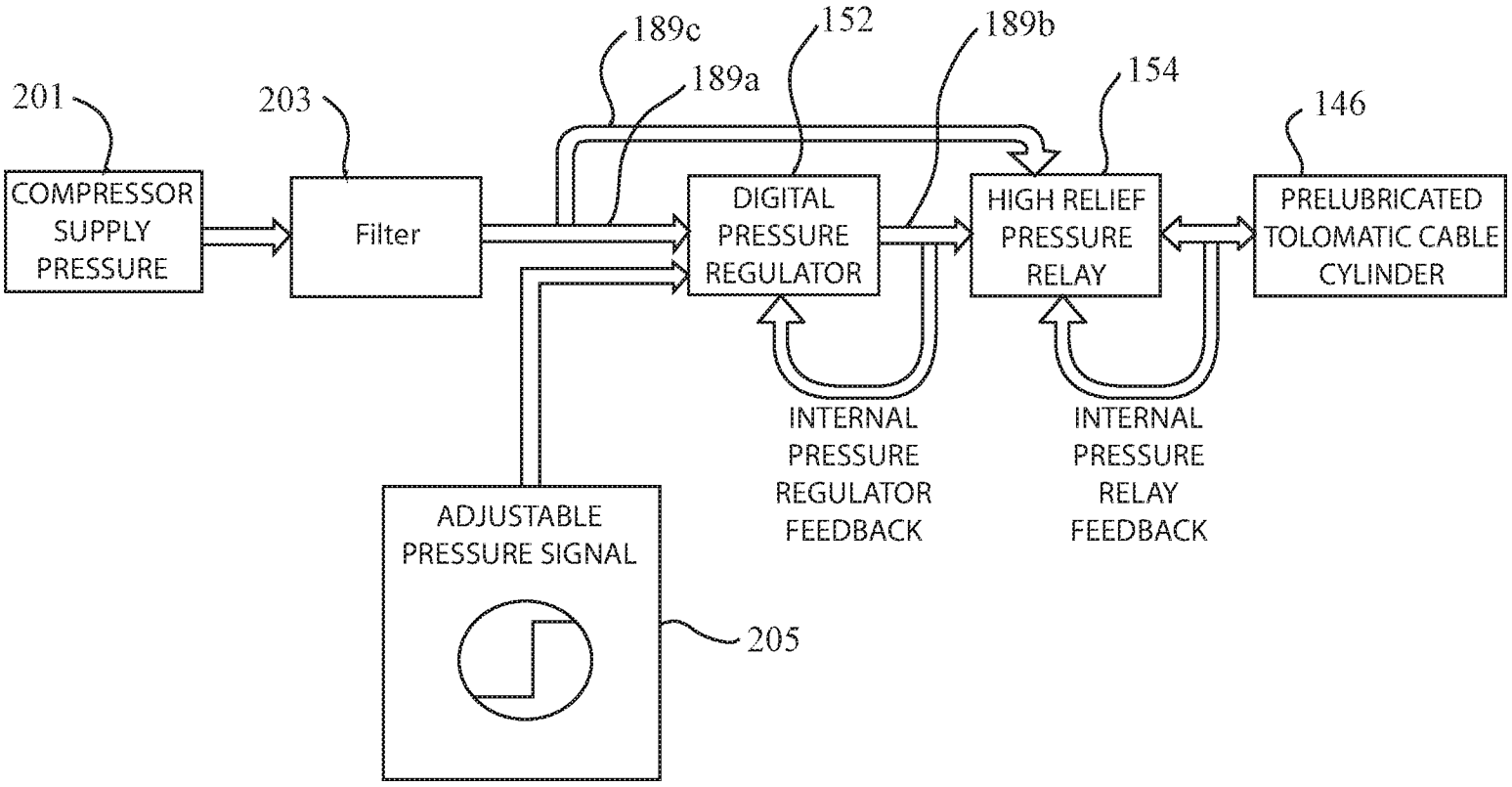
FIG. 6 is a schematic diagram of the pneumatic system of FIG. 5.

According to one aspect, the force on the piston in the cylinder 146 may be controlled by controller 118 through use of the digital pressure regulator 152 and the high relief pressure relay 154. Thus, as seen in FIGS. 5 and 6, the digital pressure regulator 152, such as a SMC ITV1000 digital pressure regulator available from SMC Corporation of Tokyo, Japan, with internal pressure regulator feedback is provided with a source of filtered compressed air (via tube 189*a*) from a compressor 201 filtered by filter 203. Based on pressure signal instructions 205 from the controller 118 (via an electrical connection), the digital pressure regulator 152 steps down the pressure to a desired pressure indicated by the controller 118. The digital pressure regulator 152 provides a reference pressure signal via tube 189*b* to the high relief pressure relay 154, such as a ControlAir 200HR 210BC available from ControlAir Inc., of Amherst, N.H. The high relief pressure relay 154 with internal pressure relay feedback also receives the filtered compressed air via tube 189*c*, and steps the pressure of that filtered compressed air down to the pressure provided by the digital pressure regulator 152. The compressed air from the high relief pressure relay 154 is provided via tube 189*d* which is inserted into and fixed in a hole (not shown) near the bottom of the pre-lubricated cylinder 146. In this manner, the pressure in the bottom chamber of the cylinder 146 is set and controlled by controller 118 via the digital pressure regulator 152 and the high relief pressure relay 154. It should be appreciated that when the sheaves 144 move down from the force exerted by the dancer cable 183, the piston travels upward thereby increasing the volume of the bottom chamber of the cylinder 146 while decreasing the volume of the top chamber. As a result, air is exhausted to atmosphere from the top chamber which is not pressurized, and air supplied by high relief pressure relay 154 enters the bottom chamber through tube 189*d*. Conversely, when the sheaves 144 move up against the force of the dancer cable 183, thereby pushing the piston down and decreasing the volume of the bottom chamber of the cylinder 146 while increasing the volume of the top chamber, air is exhausted via tube 189*d* through the high relief pressure relay 154. In one aspect, because cylinder 146 is pre-lubricated and a lubricator is not provided in the exhaust path, the air may be exhausted via the high relief pressure relay 154 quickly without incurring the backpressure associated with a lubricator.

As shown in FIG. 5, the digital pressure regulator 152 and high relief pressure relay 154 are supported by the horizontal beam 180*b* of the dancer. Also as shown in FIG. 5, the distance between the sheaves 142 and 144 may be monitored by a sensor 148 which may also act as a limit switch. More particularly, height sensor 148 provides a light signal source (e.g., a laser) that is directed at a reflective surface 191 coupled to the bottom sheaves 144, and a light detector. Based on the location of the reflective surface 191 relative to the light source, the height sensor 148 determines a distance between the sensor and the reflective surface 191 coupled to the bottom sheaves 144, and that determination may be sent as a signal to one or more of the payoff unit 112, the take-up unit 116, and the controller 118 to cause the payoff unit 112 and/or the take-up unit 116 to modify its operation speed. If, for any reason, the lower sheaves 144 should move all of the way up to the height sensor 148, a switch 148*a* on the height sensor 148 is activated and shuts off power to the drives.

As will be appreciated, in order to effect winding of a coil with the first two or more layers or a desired length of wire at a first lower tension and succeeding layers at higher tension(s), the controller 118 may be programmed to send signals to the digital pressure regulator 152 of the dancer 114 to control the pressure in the lower chamber of the pneumatic cylinder 146. In particular, at the start of the winding of a coil, the controller 118 may send a signal to the digital pressure regulator 152 to provide a low tension on the wire 110. Then, based on the monitoring of the winding, for example, by using encoder 143*c* to monitor the amount of wire leaving the accumulator, the controller 118 may send a signal to the digital pressure regulator 152 to increase the tension on the wire 110 in accord with the profile of FIG. 3*a* or FIG. 3*b*, or any other desired profile.

It will be appreciated that the system 100 has been described as including a controller 118. The controller 118 is shown as a separate unit, but it should be appreciated that the controller may also reside with the take-up unit 116, the dancer 114, or the payoff unit 112, or may be distributed amongst them. The controller 118 may have a touch-screen or other interface that permits a user to select a tension control profile for the coil, and includes a processor or processing system. The terms "processor" and "processing system" (hereinafter "processing system") should not be construed to limit the embodiments disclosed herein to any particular device type or system. The processing system may be a laptop computer, a desktop computer, or a mainframe computer. The processing system may also include a processor (e.g., a microprocessor, microcontroller, digital signal processor, programmable logic controller, or general purpose computer) for executing any of the methods and described above. The processing system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. This memory may be used to store, for example, tension parameters, coil lengths at which the tension is changed, and instructions for performing the methods described above.

Any of the methods described above can be implemented as computer program logic for use with the processing system. The computer program logic may be embodied in various forms, including a source code form or a computer executable form. Source code may include a series of computer program instructions in a variety of programming languages (e.g., an object code, an assembly language, or a high-level language such as FORTRAN, C, C++, or JAVA). Such computer instructions can be stored in a non-transitory computer readable medium (e.g. memory), and executed by the processing system. The computer instructions may be distributed in any form as a removable storage medium with accompanying printed or electronic documentation (e.g. shrink wrapped software), preloaded with a computer system (e.g. on system ROM or fixed disk), or distributed via Internet Protocol (IP).

There have been described and illustrated herein several embodiments of an apparatus and method for winding a coil. While particular embodiments have been described, it is not intended that the invention be limited thereto, as it is intended that the invention be as broad in scope as the art will allow and that the specification be read likewise. It will therefore be appreciated by those skilled in the art that modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for winding wire, comprising:

a) a wire take-up unit including a rotating mandrel and a wire directing device, said wire directing device configured to cause said wire to be wound in a figure-eight configuration on said rotating mandrel to form a coil having a plurality of layers of the wire;

b) a wire tensioning unit configured to apply tension to said wire as it is wound, said wire tensioning unit having a tension applier that applies a first amount of tension to a predetermined amount of the wire constituting a radially inner portion of the coil, and applies a second amount of tension to the wire beyond said predetermined amount constituting a radially outer portion of the coil that is radially outward of the inner portion, said second amount of tension being higher than said first amount of tension.

2. The system according to claim 1, wherein:

said second amount of tension is at least 50% higher than said first amount of tension.

3. The system according to claim 1, wherein:

said first amount of tension is between two and six pounds per square inch of tension, and said second amount of tension is between eight and twenty-five pounds per square inch of tension.

4. The system according to claim 1, wherein:

said predetermined amount of wire comprises between one hundred and one hundred eighty feet of the wire.

5. The system according to claim 1, wherein:

said wire tensioning unit comprises at least one first sheave and at least one second sheave movable relative to said at least one first sheave around which the wire can wrap.

6. The system according to claim 5, wherein:

said tension applier comprises a pneumatic cylinder coupled to and applying pressure to said at least one second sheave, and wherein said pneumatic cylinder includes a piston forming a first pressurized chamber and a second chamber in said pneumatic cylinder, and a cylinder wire coupled to a first end of said piston, extending through said first pressurized chamber and out a first end of said pneumatic cylinder, extending into a second end of said pneumatic cylinder and through said second chamber and coupled to a second end of said piston, said cylinder wire being coupled to said at least one second sheave.

7. The system according to claim 6, wherein:

said wire tensioning unit comprises a regulator coupled to and controlling a pressure in said first pressurized chamber.

8. The system according to claim 7, wherein:

said pneumatic cylinder is a pre-lubricated pneumatic cylinder, and said regulator comprises a digital regulator coupled to a self-relieving pressure relay, said self-relieving pressure relay being pneumatically coupled to said first pressurized chamber.

9. The system according to claim 8, further comprising:

a controller coupled to said digital regulator of said wire tensioning unit and providing a tension control signal to said digital regulator; and a monitor coupled to said controller, said monitor providing signals to said controller, said signals used by said controller to determine whether said first amount of tension should be increased to said second amount of tension.

10. The system according to claim 9, wherein:

said monitor is a wire footage counter.

11. The system according to claim 10, wherein:

said wire footage counter is coupled between one of said at least one first sheave and at least one second sheave of said wire tensioning unit and said wire take-up unit.

12. The system according to claim 11, wherein:

said wire footage counter comprises a plurality of rollers and an encoder that monitors rotation of at least one of said plurality of rollers.

13. The system according to claim 1, wherein:

said wire directing device is a reciprocating traverse.

14. The system for winding wire, comprising:

a) a wire take-up unit including a rotating mandrel and a reciprocating traverse arranged to cause said wire to be wound in a figure-eight configuration on said rotating mandrel to form a coil having a plurality of layers of wire;

b) a wire tensioning unit that applies tension to said wire as it is wound, said wire tensioning unit having a tension application system that is configured to apply a first amount of tension to a predetermined amount of the wire constituting a radially inner portion of the coil, and applies a second amount of tension to the wire beyond said predetermined amount constituting a radially outer portion of the coil that is radially outward of the inner portion, said second amount of tension being higher than said first amount of tension;

c) a controller coupled to said tension application system and providing a tension control signal to said tension application system; and d) a monitor coupled to said controller, said monitor providing signals to said controller, said signals used by said controller to determine whether said first amount of tension should be increased to said second amount of tension.

15. The system according to claim 14, wherein:

said second amount of tension is at least 50% higher than said first amount of tension.

16. The system according to claim 14, wherein:

said wire tensioning unit includes at least one first sheave and at least one second sheave movable relative to said at least one first sheave around which the wire can wrap.

17. The system according to claim 16, wherein:

said tension application system comprises a pneumatic cylinder, a piston forming a first pressurized chamber and a second chamber in said pneumatic cylinder, and a regulator coupled to and controlling a pressure in said first pressurized chamber, and wherein said regulator comprises a digital regulator coupled to a self-relieving pressure relay, said self-relieving pressure relay being pneumatically coupled to said first pressurized chamber, and said tension application system comprises a cylinder wire coupled to a first end of said piston, extending through said first pressurized chamber and out a first end of said pneumatic cylinder, extending into a second end of said pneumatic cylinder and through said second chamber and coupled to a second end of said piston, said cylinder wire being coupled to said at least one second sheave.

18. A method, comprising:

winding a wire over a mandrel to form a coil with a plurality of wire layers, said winding comprising winding in a figure-eight pattern with a speed bias so that each wire layer comprises multiple figure-eight windings, and controllably applying tension to the wire during said winding so that wire layers of a radially inner portion of said coil are wound at a relatively low tension, and increasing the tension so that at least fifty percent of the wire layers are wound at a relatively high tension which is higher than said relatively low tension.

19. The method according to claim 18, wherein:

said relatively high tension is at least 50% higher than said relatively low tension.

20. A method according to claim 18, wherein:

said controllably applying tension comprises monitoring said winding and automatically increasing tension after a predetermined amount of wire is wound at said relatively low tension.

* * * * *